United States Patent [19]

Bachor

[11] 4,319,794

[45] Mar. 16, 1982

[54] CABINET WITH A DETACHABLE DOOR

[75] Inventor: Jürgen Bachor, Kirchlengern, Fed. Rep. of Germany

[73] Assignee: Paul Hettich & Co., Kirchlengern, Fed. Rep. of Germany

[21] Appl. No.: 150,406

[22] Filed: May 13, 1980

[30] Foreign Application Priority Data

May 17, 1979 [DE] Fed. Rep. of Germany ... 7914232[U]

[51] Int. Cl.[3] ..... A47B 81/00; E05D 15/00

[52] U.S. Cl. ..... 312/293; 24/208 A; 24/217 R; 16/257

[58] Field of Search ..... 312/293; 16/128 B, 151, 16/158, 169; 24/208 A, 216, 217

[56] References Cited

U.S. PATENT DOCUMENTS

| | | | |
|---|---|---|---|
| 1,124,048 | 1/1915 | Malaspina | 16/158 |
| 1,583,084 | 5/1926 | Malmberg | 16/158 |
| 1,618,544 | 2/1927 | McKinney, Jr. | 16/169 |
| 2,624,907 | 1/1953 | Graham | 16/128 B |
| 2,637,422 | 5/1953 | Bell | 16/158 |
| 3,146,486 | 9/1964 | Hoffman | 16/151 |
| 3,328,832 | 7/1967 | Simpson et al. | 16/151 |
| 3,407,717 | 10/1968 | Ernisse | 24/208 A |
| 3,916,756 | 11/1975 | Yoda | 24/217 R |
| 4,200,956 | 5/1980 | Ullman, Jr. | 16/151 |
| 4,233,715 | 11/1980 | McDermott | 24/217 R |

*Primary Examiner*—Victor N. Sakran
*Attorney, Agent, or Firm*—Michael J. Striker

[57] ABSTRACT

A cabinet with a glass door is formed by inserting into the top and bottom walls of the cabinet a hinge part composed of a bushing and two elastic members with projections. Inserted between these elastic members and secured against the bushing by them is a hinge post which is a part of a second hinge part that has a receiving slot. The receiving slot is operative for receiving the glass door which is secured in the pocket by a clamping screw. In this way the door may be easily and quickly installed and removed.

4 Claims, 8 Drawing Figures

CABINET WITH A DETACHABLE DOOR

BACKGROUND OF THE INVENTION

The invention relates to a cabinet with a door, particularly a glass door, which is mounted on the body of the cabinet with hinges. Some parts of the hinges are attached to the door casement and have a locking mechanism for securing the hinge post and thereby the door.

Cabinets with hinged doors are known in the prior art. However, the known doors suffer from the disadvantage that they cannot be easily and quickly removed from their hinges and replaced with equal ease and speed.

SUMMARY OF THE INVENTION

An objective of the invention is to produce a cabinet having a door, especially a glass door, which may be quickly and easily removed and replaced. Another objective is to attach the door to the cabinet body with hinge parts that are also capable of being easily and quickly installed and removed.

According to the invention these objectives are satisfied by use of a hinge post which is attached to the door by means of a receiving pocket. The hinge post is arrested in another hinge part by a locking mechanism.

Another aspect of the invention consists of forming the locking mechanism in the cabinet body with elastic members which secure the hinge post against a bushing. An additional aspect is providing the elastic members with a convex surface to permit a more reliable contact area for the hinge part.

Yet another aspect of the invention is the use of a clamping screw to secure the door, e.g., a pane of glass, within the receiving pocket. This permits the door to be opened; the screw to be loosened; and the smooth door to be removed from the still intact hinge in a quick, easy manner. Once the door is thus removed, the hinge part bearing the post can be removed from the hinge part located in the cabinet body in a quick and simple fashion. Further, mounting the door is a mere reversal of this procedure, i.e., the hinge post is simply inserted into the bushing and is automatically secured against the bushing by the elastic members which press against the hinge post, but which still permit the post to rotate. The door is then inserted into the receiving pockets and the clamping screw is tightened to secure the door.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
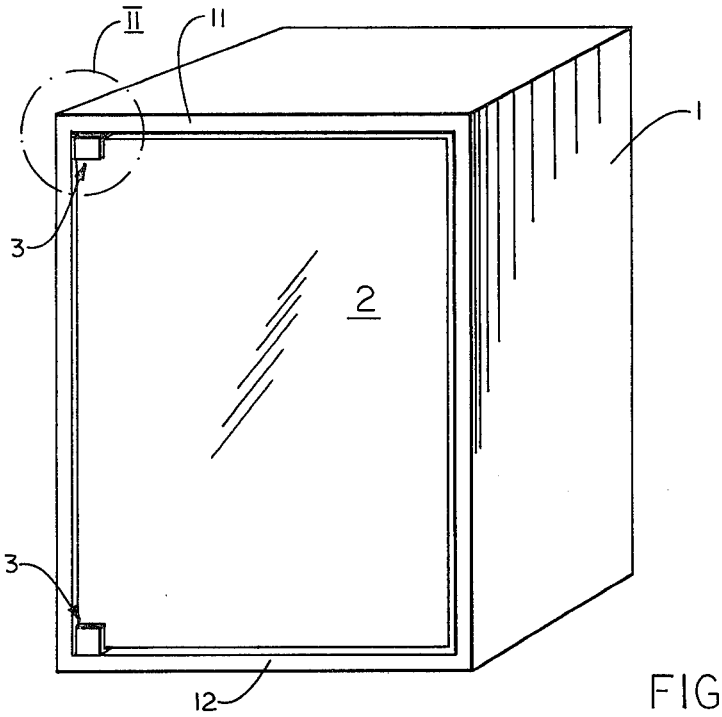
FIG. 1 is a perspective view of a cabinet with hinged glass door.
Figure 2:
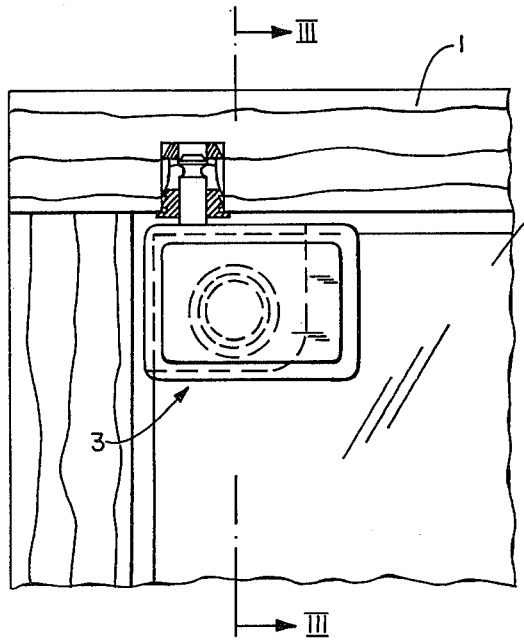
FIG. 2 is a cut-away detail of region II of FIG. 1.
Figure 3:
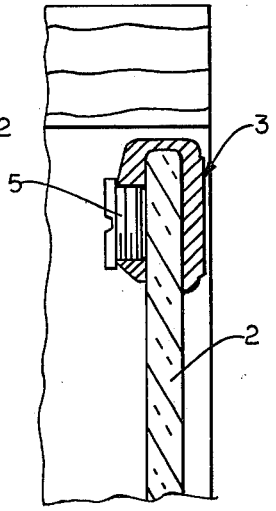
FIG. 3 is a side view of a detail of FIG. 2, taken along line III—III of FIG. 2.
Figure 5:
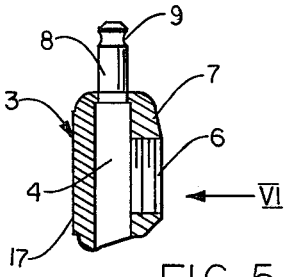
FIG. 5 is a section view along line V—V in FIG. 4.
Figure 4:
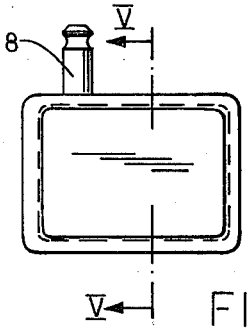
FIG. 4 is a front view of the hinge part with hinge post.
Figure 6:
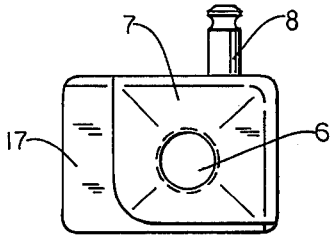
FIG. 6 is a view in the direction VI as shown in FIG. 5.
Figure 7:
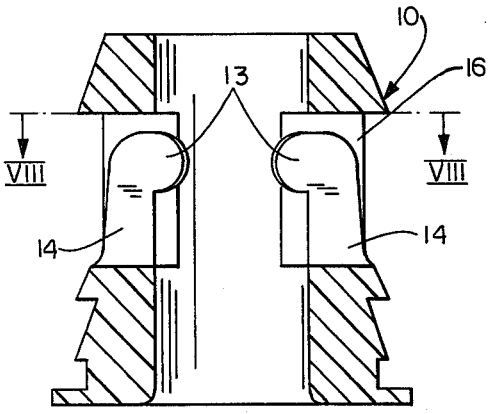
FIG. 7 is a vertical sectional view of the hinge part fixed in the cabinet body.
Figure 8:
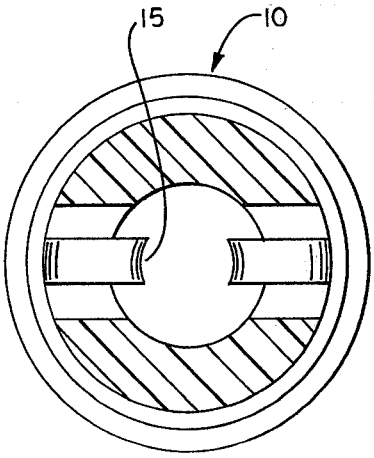
FIG. 8 is a section along line VIII—VIII in FIG. 7.

The cabinet body 1, as seen in FIG. 1, is equipped with a glass door 2, which is hinged about a rotary axis onto the body of the cabinet. Hinge part 3 has a receiving pocket 4, as seen in FIG. 5, which receives the glass door 2 in the region of the rotary axis. These hinge parts are fitted to the upper and lower edges of the glass door. The glass door is secured in the receiving pocket 4 by a clamping screw 5, shown in FIG. 3, that is secured into a threaded hole 6 in the wall 7 of the hinge part 3. Wall 7 is the wall facing the interior of the cabinet 1. Hinge part 3 is furnished with a hinge post 8 which has an annular groove 9 near its free end. As shown in FIG. 7, the part of the hinge that holds the hinge post while still permitting it to rotate consists of a bushing 10 and two elastic members 14 which have locking projections 13. As seen in FIG. 2 the annular groove 9 of hinge post 8 is inserted between the elastic members until it is secured by the locking projections 13, and simultaneously the upper end of the post is lodged against the bushing 10. The bushing 10 and elastic members 14 are placed in cavities above the lower edge of cabinet top 11 and beneath the upper edge of cabinet floor 12. As shown in FIG. 8 the locking projections 13 have convex surfaces so that a reliable fit with the annular groove 9 of hinge post 8 is achieved. In the region 16 of the locking projection 13 the elastic member 14 is given a large amount of mobility within region 16 so that the members 14 may be further separated to allow removal of the hinge post 8. The receiving pocket 4 is bounded by a front wall 17, shown in FIG. 6, which has greater extension then the rear wall 7. It is advantageous, though not necessary, to form the receiving pocket walls 7, 17 and the hinge post 8 out of metal, and to form the bushing 10 out of plastic.

It will be understood that each of the elements described above, or two or more together, may also find a useful application in other types of constructions differing from the types described above.

While the invention has been illustrated and described as embodied in a cabinet with a detachable door it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cabinet with a door, particularly a glass door, comprising a cabinet body; a door; a receiving pocket part securably attached to said door; a hinge post having an upper end and a lower end, said lower end being attached to said receiving pocket part; and a bushing part mounted on said cabinet body and operative for receiving said upper end of said hinge post so that said post may rotate, said bushing part including a bushing and locking means for securing said hinge post; said locking means including two opposite elastic members having locking projections, said hinge post being formed with an annular groove in the vicinity of its upper end, said hinge post abutting against said bushing, and said locking projections engaging said groove.

2. A cabinet as defined in claim 1, wherein said receiving pocket part is made out of metal, said hinge post is made out of metal, and said bushing part is made out of plastic.

3. A cabinet as defined in claim 1, wherein said locking projections have convex surfaces that fit against said annular groove of said hinge post.

4. A cabinet as defined in claim 1, wherein said bushing part being formed with a space between said bushing and said elastic member.

* * * * *